US007034269B2

(12) United States Patent
Jeong

(10) Patent No.: US 7,034,269 B2
(45) Date of Patent: Apr. 25, 2006

(54) WALL-MOUNTED MICROWAVE OVEN

(75) Inventor: San-Jin Jeong, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 129 days.

(21) Appl. No.: 10/320,422

(22) Filed: Dec. 17, 2002

(65) Prior Publication Data

US 2004/0004077 A1 Jan. 8, 2004

(30) Foreign Application Priority Data

Jul. 8, 2002 (KR) ..... 2002-39486

(51) Int. Cl.
*H05B 6/64* (2006.01)

(52) U.S. Cl. ..... 219/757; 219/756; 126/299 R; 126/299 D

(58) Field of Classification Search ..... 219/756, 219/757; 126/21 A, 299 R, 299 D, 190, 126/200, 301
See application file for complete search history.

(56) References Cited

U.S. PATENT DOCUMENTS

| | | | | | |
|---|---|---|---|---|---|
| 1,954,257 | A | * | 4/1934 | Nessel | 126/301 |
| 3,356,008 | A | * | 12/1967 | Simpson et al. | 126/299 D |
| 3,943,319 | A | * | 3/1976 | Hirai et al. | 219/739 |
| 4,286,572 | A | * | 9/1981 | Searcy et al. | 126/299 D |
| 4,418,261 | A | * | 11/1983 | Jailor et al. | 219/757 |
| 4,738,244 | A | * | 4/1988 | Welsh | 126/299 R |
| 4,788,964 | A | * | 12/1988 | Dorsey et al. | 126/299 R |
| 4,886,046 | A | | 12/1989 | Welch | |
| 5,375,587 | A | * | 12/1994 | Ward et al. | 126/190 |
| 5,986,245 | A | * | 11/1999 | Kang | 219/702 |
| 6,239,419 | B1 | | 5/2001 | Kim | |
| 6,291,809 | B1 | * | 9/2001 | Ha | 219/757 |
| 6,586,716 | B1 | * | 7/2003 | Lee | 219/757 |
| 6,621,058 | B1 | * | 9/2003 | Kim | 219/757 |
| 6,622,717 | B1 | * | 9/2003 | Kim | 126/299 D |
| 2003/0226842 | A1 | * | 12/2003 | Lee | 219/757 |
| 2004/0000547 | A1 | * | 1/2004 | Kim | 219/757 |

FOREIGN PATENT DOCUMENTS

| | | | |
|---|---|---|---|
| DE | 2640710 | * | 3/1977 |
| JP | 403017458 | * | 1/1991 |
| JP | 405126375 | * | 5/1993 |
| KR | U1987-10638 | | 7/1987 |
| KR | 96-38110 | | 12/1996 |
| KR | U1997-44290 | | 7/1997 |

OTHER PUBLICATIONS

English language translation of Korean Patent 2001-56964.

* cited by examiner

*Primary Examiner*—Robin O. Evans
*Assistant Examiner*—Leonid Fastovsky
(74) *Attorney, Agent, or Firm*—Staas & Halsey LLP

(57) ABSTRACT

A wall-mounted microwave oven is provided capable of performing an exhaust function irrespective of a folded state or an unfolded state of a guide plate while achieving an improvement in the exhaust function. The wall-mounted microwave oven includes an oven body, and the guide plate to guide fumes or smoke rising toward the oven body to an exhaust suction port formed at a bottom wall of the oven body. The guide plate is hingeably mounted to a front wall of the oven body to hinge upwardly to a folded position thereof or hinging downwardly to an unfolded position thereof.

28 Claims, 5 Drawing Sheets

WALL-MOUNTED MICROWAVE OVEN

CROSS-REFERENCE TO RELATED APPLICATION

This application claims the benefit of Korean Application No. 2002-39486, filed Jul. 8, 2002, in the Korean Intellectual Property Office, the disclosure of which is incorporated herein by reference.

BACKGROUND OF THE INVENTION

1. Field of the Invention

The present invention relates to a wall-mounted microwave oven, and more particularly, to a wall-mounted microwave oven including a guide plate adapted to guide fumes or smoke rising toward an oven body to an exhaust suction port formed at a bottom wall of the oven body.

2. Description of the Related Art

Generally, a wall-mounted microwave oven is installed over a gas oven range. The wall-mounted microwave oven not only performs a cooking function similar to that of general microwave ovens, but also performs a function for externally exhausting fumes or smoke rising from the gas oven range arranged beneath the microwave oven.

The wall-mounted microwave oven includes an oven body having an inner space partitioned into a cooking chamber to cook food, and a chamber receiving diverse electrical elements. Referring to FIG. 1, a wall-mounted microwave oven is illustrated. As shown in FIG. 1, the oven body 1 is provided with an exhaust fan 3 installed at a rear upper portion of the oven body 1 to exhaust fumes or smoke generated from a gas oven range 2 arranged beneath the microwave oven. An exhaust suction port 4 is formed at a bottom wall of the oven body 1 to suck the fumes or smoke rising from the gas oven range 2 in accordance with an operation of the exhaust fan 3. An exhaust path (not shown) is defined in the oven body 1 to guide the fumes or smoke sucked into the exhaust suction port 4 toward the exhaust fan 3.

A guide plate 5 is installed at the bottom wall of the oven body 1 near the front wall of the oven body 1 to guide the fumes or smoke rising from the gas oven range 2 toward the exhaust suction port 4. The guide plate 5 is hingeably mounted to the bottom wall of the oven body 1 so that the guide plate 5 is movable between a folded position and an unfolded position in accordance with a manipulation thereof by a user. When a cooking procedure is carried out using a rear heating unit 2B of the gas oven range 2, the guide plate 5 is maintained at the folded position thereof. Alternatively, when the cooking procedure is carried out using a front heating unit 2A of the gas oven range 2, the guide plate 5 is unfolded to guide the fumes or smoke generated from the gas oven range 2 toward the exhaust suction port 4 arranged at the bottom wall of the oven body 1 near the rear wall of the oven body 1.

In the above-mentioned conventional wall-mounted microwave oven, the exhaust suction port 4 is typically arranged at the rear portion of the bottom wall of the oven body 1 due to the guide plate 5 installed at the front portion of the bottom wall of the oven body 1. For this reason, effectively exhausting the fumes or smoke rising from the front heating unit 2A of the gas oven range 2 is not possible even though the exhaust function is carried out in an unfolded state of the guide plate 5.

In order to solve this problem, the exhaust suction port 4 is arrangeable at the front portion of the bottom wall of the oven body 1. In this case, however, the guide plate 5 closes the suction port 4 at the folded position thereof. As a result, the guide plate 5 is unfolded whenever the exhaust function is to be carried out, which is inconvenient. The guide plate 5 must be unfolded even when the cooking procedure is carried out using the rear heating unit 2B of the gas oven range 2.

SUMMARY OF THE INVENTION

Therefore, an aspect of the invention is to provide a wall-mounted microwave oven capable of performing an exhaust function irrespective of a folded state or an unfolded state of a guide plate while achieving an improvement in the exhaust function.

Additional aspects and advantages of the invention will be set forth in part in the description which follows and, in part, will be obvious from the description, or may be learned by practice of the invention.

A wall-mounted microwave oven is provided which includes an oven body, and a guide plate adapted to guide fumes or smoke rising toward the oven body toward an exhaust suction port formed at a bottom wall of the oven body, wherein the guide plate is hingeably mounted to a front wall of the oven body to hinge upwardly to a folded position thereof or hinging downwardly to an unfolded position thereof.

The oven body may be defined therein with a cooking chamber opened at a front surface thereof, and may be provided with a door hingeably mounted to a front wall of the oven body, and may be adapted to open and close the cooking chamber, and the guide plate may be hingeably mounted at one end thereof to a lower end of a front surface of the door.

The door may be provided at the front surface thereof with a guide plate receiving recess adapted to receive the guide plate, the guide plate receiving recess having a depth corresponding to a thickness of the guide plate.

The guide plate may have a lateral length corresponding to a lateral length of the door, and may be made of a transparent material to be transparent therethrough.

The wall-mounted microwave oven further may include a locking unit adapted to lock the guide plate at the folded position. The locking unit may comprise an engagement protrusion protruded from an end of the guide plate, and an engagement groove formed at an upper end of the guide plate receiving recess to engage with the engagement protrusion.

A stopper may be provided at a lower end of the front surface of the door to prevent the guide plate from hinging downwardly beyond the unfolded position in an unfolding direction.

The exhaust suction port may be arranged at a front portion of the bottom wall of the oven body.

BRIEF DESCRIPTION OF THE DRAWINGS

These and other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
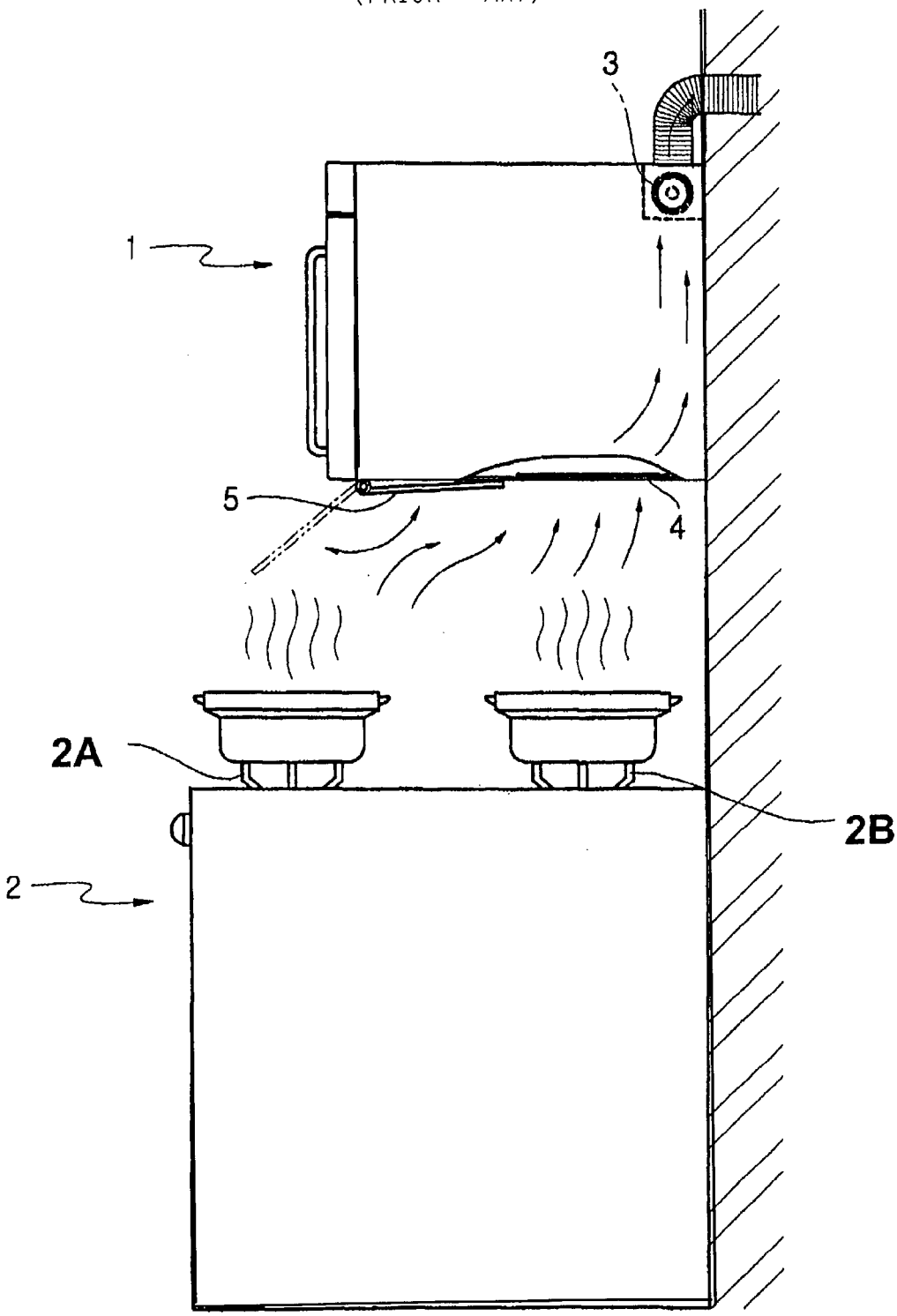
FIG. 1 (PRIOR ART)
FIG. 1 is a view showing a conventional wall-mounted microwave oven.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
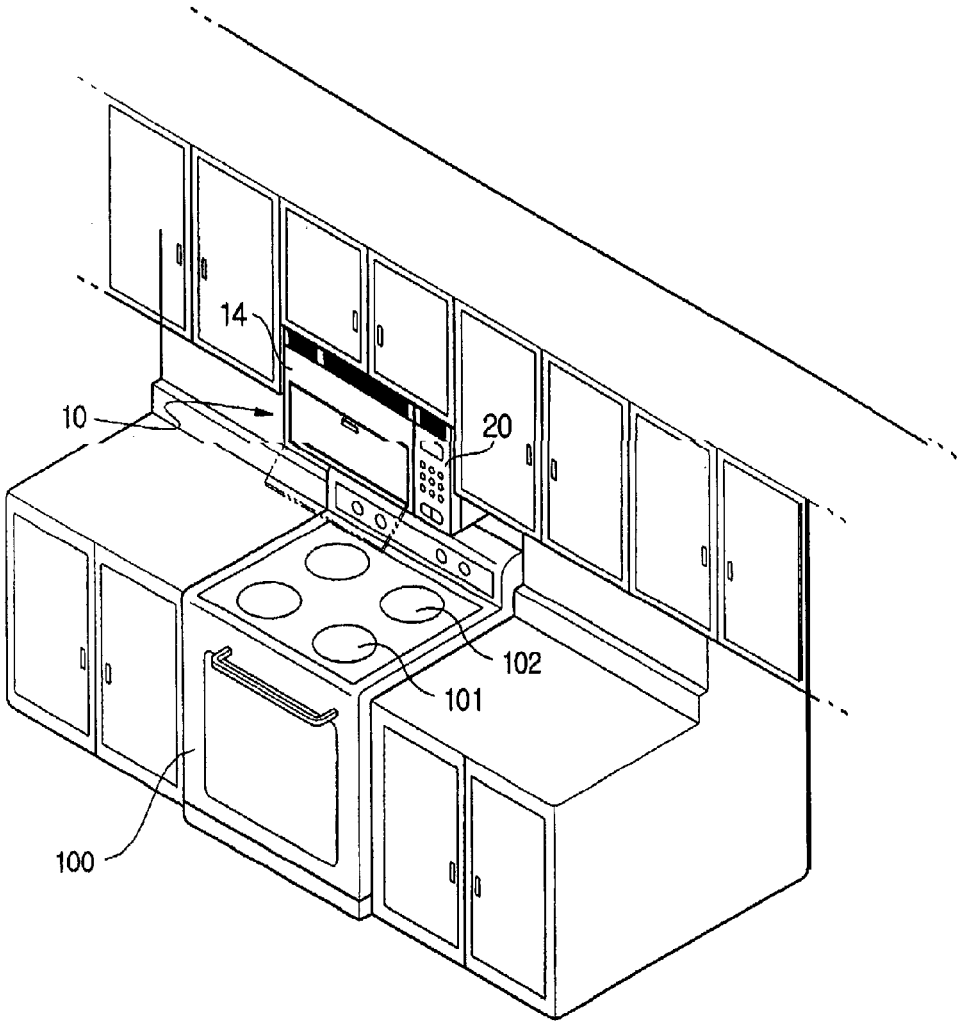
FIG. 2 is a perspective view showing a wall-mounted microwave oven of an embodiment of the present invention mounted above a gas oven range.
Figure 3:
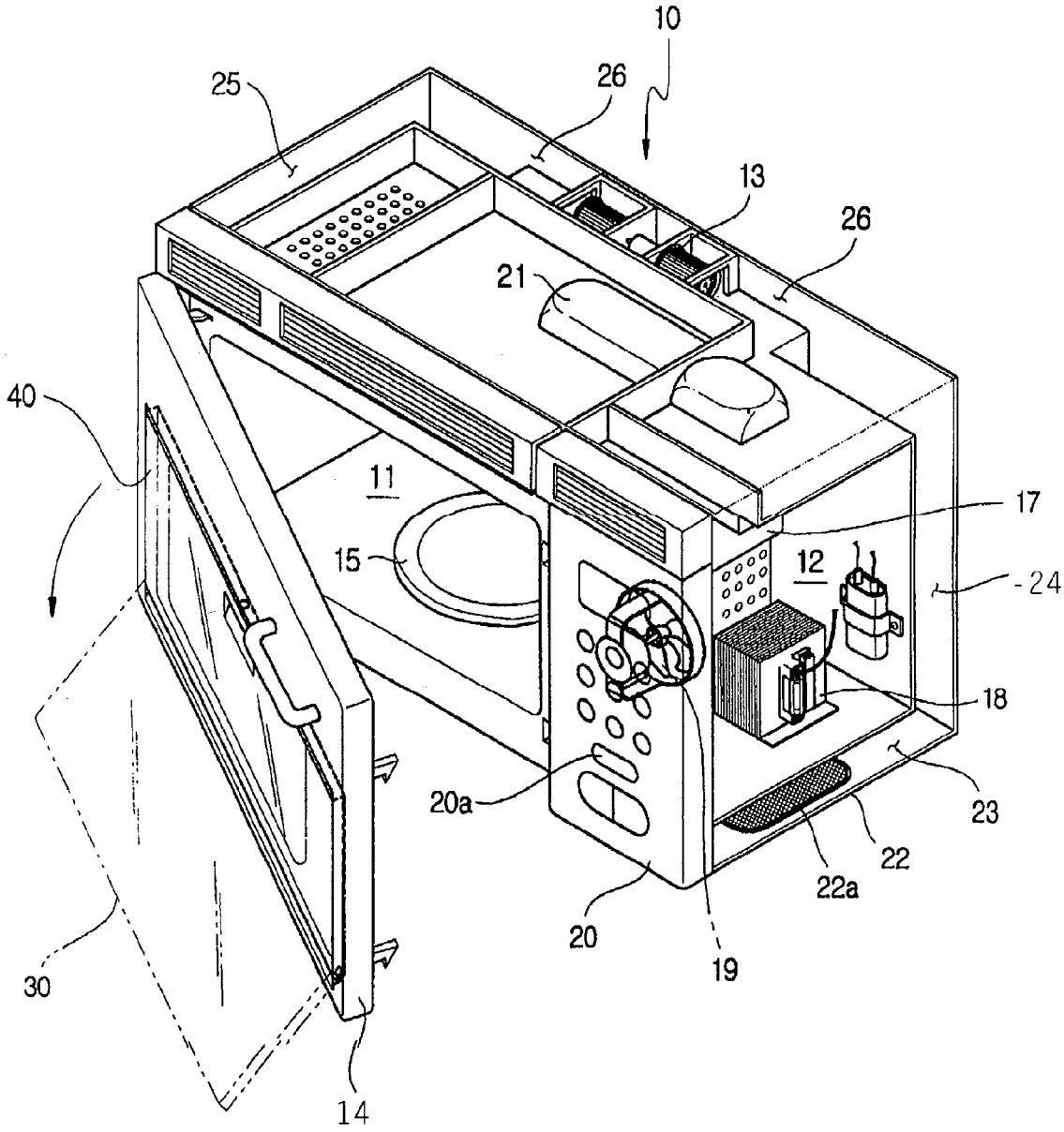
FIG. 3 is a perspective view showing the wall-mounted microwave oven of FIG. 2.

As shown in FIG. 2, a wall-mounted microwave oven according to an embodiment of the present invention is illustrated. The wall-mounted microwave oven includes an oven body 10 fixedly mounted to a building wall above a gas oven range 100. As shown in FIG. 3, the oven body 10 has an inner space partitioned into a cooking chamber 11 to cook food, and an electrical elements receiving chamber 12 receiving diverse electronic elements. An exhaust path is defined in the oven body 10 to exhaust fumes or smoke generated from the gas oven range 100 arranged beneath the oven body 10. An exhaust fan 13 is installed at a rear upper portion of the oven body 10 to externally exhaust the fumes or smoke guided via the exhaust path.

The cooking chamber 11 is opened at a front surface thereof to receive food therein. In order to open and close the front opening of the cooking chamber 11, a door 14 is installed at a front wall of the oven body 10. The door 14 is hingeably coupled to the front wall of the cooking chamber 11 at one end thereof. A turntable 15 is installed within the cooking chamber 11 to rotate the food received in the cooking chamber 11.

In the electrical element receiving chamber 12 are a magnetron 17 supplying microwaves into the cooking chamber 11, a high-voltage transformer 18 applying high voltage to the magnetron 17, and other diverse electrical elements. A cooling fan 19 is installed in the electrical element receiving chamber 12 at a front portion thereof to cool the electrical elements received in the electrical element receiving chamber 12. A manipulation panel 20, which includes a plurality of manipulation buttons 20A activating diverse functions of the microwave oven, is installed at the front surface of the electrical element receiving chamber 12. The magnetron 17 is mounted to a top surface of the electrical element receiving chamber 12, whereas the high-voltage transformer 18 is mounted to a bottom surface of the electrical element receiving chamber 12. A waveguide 21 extends along the top surface of the electrical element receiving chamber 12, and a top surface of the cooking chamber 11 to guide microwaves supplied from the magnetron 17 into the cooking chamber 11.

The exhaust path adapted to exhaust the fumes or smoke generated beneath the oven body 10 includes a lower fluid path 23 defined between bottom surfaces of the cooking chamber 11 and electrical element receiving chamber 12 and an upper surface of a bottom plate 22 while communicating with an exhaust suction port 22A formed at the bottom plate 22, a pair of vertical fluid paths 24 and 25, respectively, defined at a rear of the electrical element receiving chamber 12 and at one side of the cooking chamber 11 opposite to the electrical element receiving chamber 12 while extending vertically, and an upper fluid path 26 defined at a top portion of the oven body 10 to guide the fumes or smoke guided by the vertical fluid paths 24 and 25 toward the exhaust fan 13. In accordance with this configuration, the fumes or smoke sucked into the exhaust suction port 22A of the bottom plate 22 are exhausted while passing through the lower fluid path 23, the vertical fluid paths 24 and 25, and the upper fluid path 26, in that order.

Figure 4:
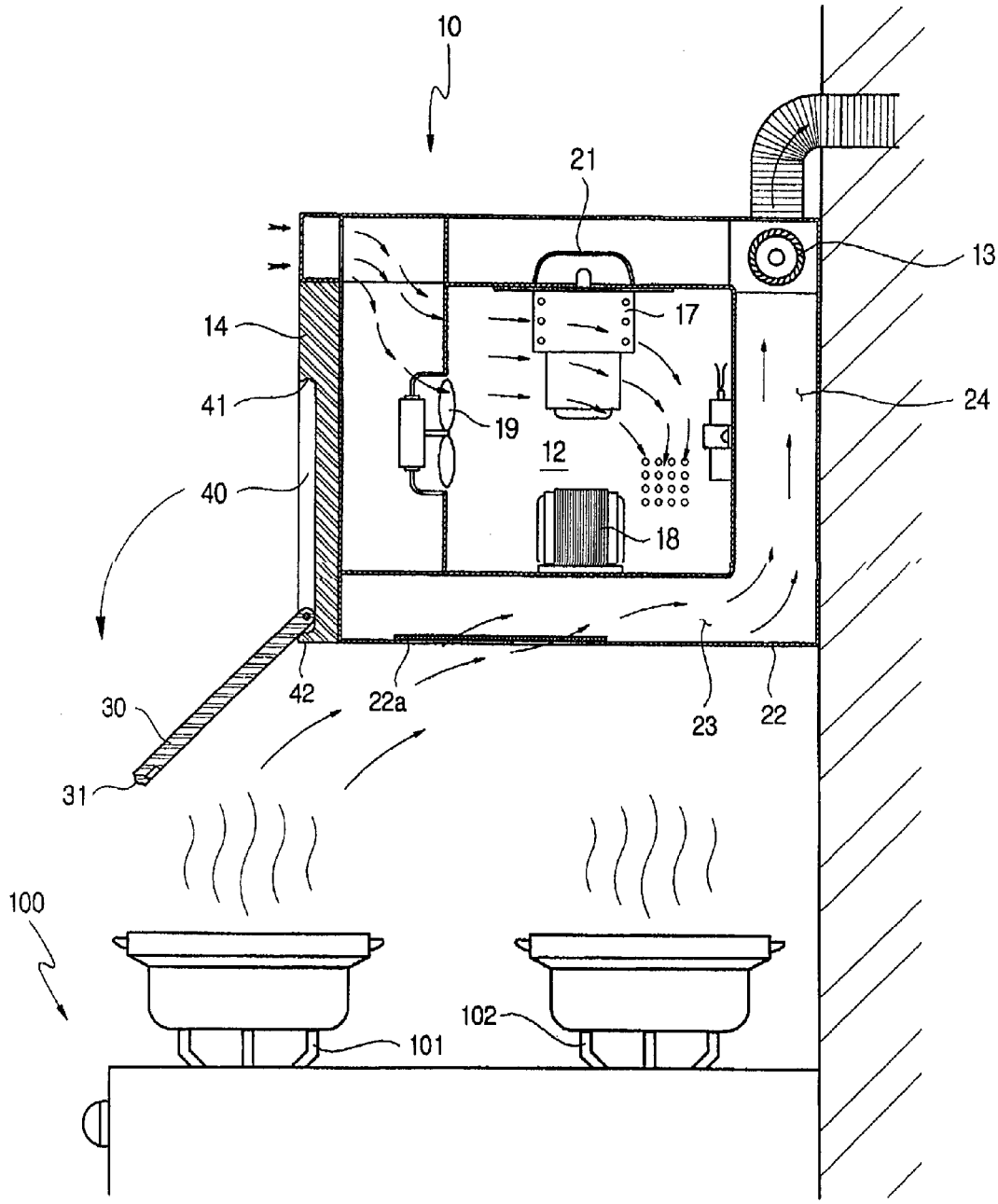
FIG. 4 is a plan view showing the wall-mounted microwave oven of FIG. 2.

The exhaust suction port 22A is arranged at a bottom wall of the oven body 10 near a front wall of the oven body 10 to easily exhaust the fumes or smoke rising from a front heating unit 101 of the gas oven range 100, as shown in FIG. 4. A guide plate 30 is also hingeably mounted to the oven body 10 to guide the rising exhaust fumes or smoke toward the exhaust suction port 22A.

The guide plate 30 has a flat plate structure having a lateral length corresponding to that of the door 14. The guide plate 30 is hingeably mounted at a lower end thereof to the lower end of a front surface of the door 14 so that the guide plate 30 hinges upwardly to a predetermined folded position thereof or hinges downwardly to a predetermined unfolded position thereof. In accordance with this configuration, the guide plate 30 does not interfere with the exhaust suction port 22A while at any position thereof. That is, the exhaust function of the exhaust suction port 22A is normally carried out, irrespective of a folded state or an unfolded state of the guide plate 30.

Figures 5A, 5B:
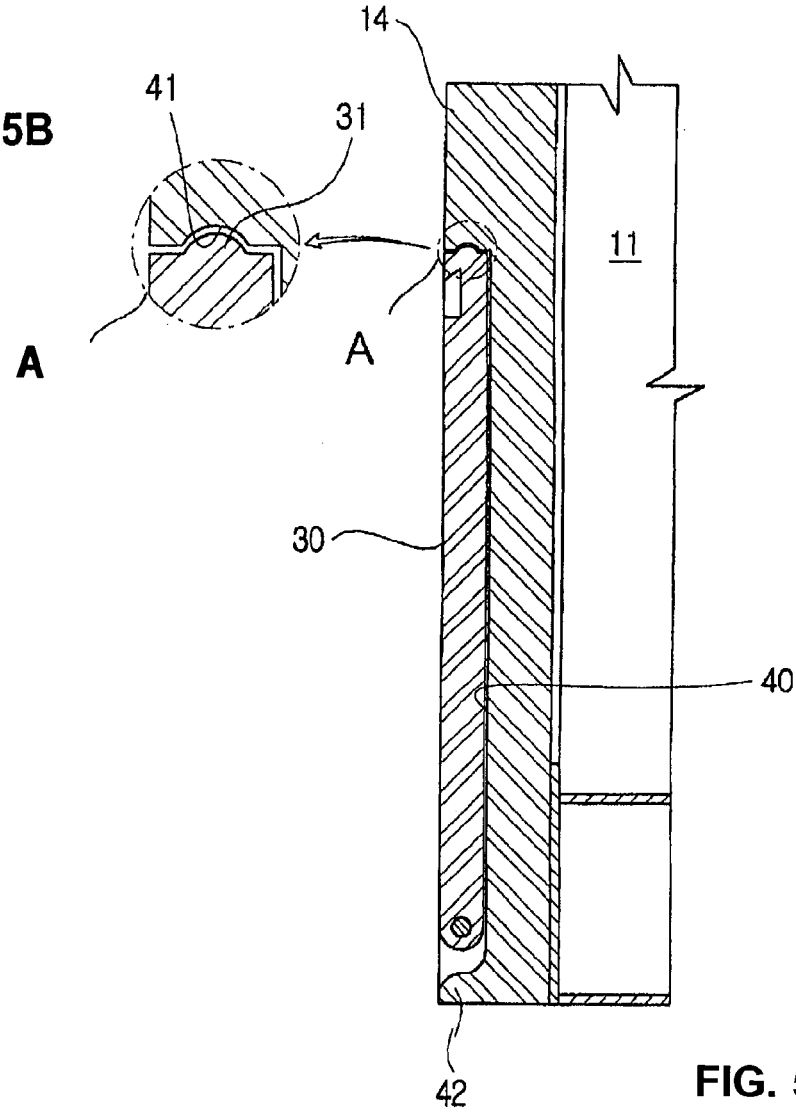
FIG. 5A is a partial plan view showing a guide plate of the wall-mounted microwave oven of FIG. 2.
FIG. 5B is an exploded view of an area A shown in FIG. 5A.

The door 14 is provided at the front surface thereof with a guide plate receiving recess 40 formed to have a depth corresponding to a thickness of the guide plate 30, and adapted to receive the guide plate 30 at the predetermined folded position of the guide plate 30. The predetermined folded position of the guide plate 30 corresponds to a folded state in which the guide plate 30 is received in the guide plate receiving recess 40. A locking unit is also provided to lock the guide plate 30 in the folded state in which the guide plate 30 is received in the guide plate receiving recess 40. As shown in FIG. 5, the locking unit comprises an engagement protrusion 31 protruded from a free end of the guide plate 30 to have a round surface, and an engagement groove 41 formed at an upper end of the guide plate receiving recess 40 to engage with the engagement protrusion 31.

A stopper 42 is provided at the lower end of the front surface of the door 14 at a lower end of the guide plate receiving recess 40, as shown in FIG. 4. The stopper 42 serves to prevent the guide plate 30 from hinging downwardly beyond the predetermined unfolded position in an unfolding direction. Thus, the guide plate 30 is held at the predetermined unfolded position by the stopper 42. It should be appreciated that the predetermined unfolded position corresponds to an unfolded position of the guide plate 30 where the guide plate 30 extends forwardly and downwardly to optimize the guide function thereof.

The guide plate 30 may be made of a transparent material to avoid obscuring a view of the user by the unfolded guide plate 30 during a cooking procedure using the gas oven range 100.

The operation of the wall-mounted microwave oven having the above described configuration will now be described.

In a cooking procedure in the cooking chamber 11, microwaves emitted from the magnetron 17 installed in the electrical element receiving chamber 12 are irradiated into the cooking chamber 11, so that food received in the cooking chamber 11 is cooked. When the fumes or smoke generated from the gas oven range 100 arranged beneath the oven body 10 are desired to be exhausted, the user manipulates an exhaust function button provided at the manipulation panel 20, thereby causing the exhaust fan 13 installed at the rear upper portion of the oven body 10 to operate. In accordance with the operation of the exhaust fan 13, the fumes or smoke generated from gas oven range 100 are externally exhausted through the exhaust path 24–26. The fumes or smoke from the gas oven range 100 enter the lower fluid path 23 through the exhaust suction port 22A formed at the bottom wall of the oven body 10, rise along the vertical fluid paths 24 and 25, respectively, defined at the rear of the electrical element receiving chamber 12 and at one side of the cooking chamber 11, and then flow toward the exhaust fan 13 via the upper fluid path 26 formed at the top portion of the oven body 10, so as to be externally exhausted by the exhaust fan 13.

During the exhaust operation, the guide plate 30 is unfolded to the unfolded position to guide the fumes or smoke rising from the gas oven range 100 toward the exhaust suction port 22A, as shown in FIG. 4. In accordance with the present invention, an exhaustion of the fumes or smoke rising from the gas oven range 100 is effectively carried out because the fumes or smoke rising from the front heating unit 101 of the gas oven range 100 toward the exhaust suction port 22A are guided by the guide plate 30, and exhausted through the exhaust suction port 22A arranged at the front portion of the bottom wall of the oven body 10.

Where no exhaust operation is carried out or the cooking operation is carried out at a rear heating unit 102 of the gas oven range 100, the guide plate 30 is upwardly hinged so that the guide plate 30 is held at the folded position thereof. The fumes or smoke rising from the rear heating unit 102 of the gas oven range 100 can be sucked into the exhaust suction portion 22A even though the guide plate 30 is held at the folded position thereof. Thus, exhaustion of the fumes or smoke generated from the gas oven range 100 can be effectively exhausted.

As is apparent from the above description, the wall-mounted microwave oven is provided including the guide plate hingeably mounted to the front wall of the oven body to hinge upwardly to the folded position thereof while hinging downwardly to the unfolded position thereof, and the exhaust suction port formed at the front portion of the bottom wall of the oven body, thereby being capable of performing an exhaust function irrespective of the folded state or the unfolded state of the guide plate while effectively exhausting the fumes or smoke rising from the front heating unit of the gas oven range arranged beneath the oven body.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A wall-mounted microwave oven, comprising:

an oven body; and a guide plate adapted to guide fumes or smoke rising toward the oven body to an exhaust suction port formed at a bottom wall of the oven body, wherein the guide plate is hingeably mounted to a front wall of the oven body to hinge upwardly to a folded position thereof or to hinge downwardly to an unfolded position thereof, wherein the oven body is defined therein by a cooking chamber opened at a front surface thereof, and provided with a door hingeably mounted to the front wall of the oven body, the door opening and closing the cooking chamber, and the guide plate hingeably mounted at one end thereof to a lower end of a front surface of the door.

2. The wall-mounted microwave oven according to claim 1, wherein the door is provided at the front surface thereof with a guide plate receiving recess to receive the guide plate, the guide plate receiving recess having a depth corresponding to a thickness of the guide plate.

3. The wall-mounted microwave oven according to claim 2, wherein the guide plate has a lateral length corresponding to a lateral length of the door, and is made of a transparent material to be transparent therethrough.

4. The wall-mounted microwave oven according to claim 2, further comprising:

a locking unit to lock the guide plate at the folded position, the locking unit comprising:

an engagement protrusion protruded from one end of the guide plate, and an engagement groove formed at an upper end of the guide plate receiving recess to engage with the engagement protrusion.

5. The wall-mounted microwave oven according to claim 1, further comprising:

a stopper provided at the lower end of the front surface of the door to prevent the guide plate from hinging downwardly beyond the unfolded position in an unfolding direction.

6. The wall-mounted microwave oven according to claim 1, wherein the exhaust suction port is arranged at a front portion of the bottom wall of the oven body.

7. A wall-mounted microwave oven having an oven body with an exhaust port formed at the oven body to exhaust fumes or smoke, comprising:

a guide plate hingeably mounted to a front wall of the microwave oven and guiding the fumes or smoke from around the microwave oven toward the exhaust port of the oven body a cooking chamber defining an opening in the oven body; and a door mounted to a front wall of the oven body to open or to close the opening in the oven body, wherein the guide plate is hingeably mounted at one end thereof to a lower end of the door.

8. The wall-mounted microwave oven according to claim 7, wherein the guide plate hinges to one of a folded position when the guide plate is not in operation and an unfolded position when the guide plate is in operation.

9. The wall-mounted microwave oven according to claim 8, wherein the guide plate, in either of the folded or unfolded positions does not cover a bottom surface of the microwave oven.

10. The wall-mounted microwave oven according to claim 7, wherein the exhaust port is arranged at a front portion of a bottom wall of the oven body.

11. The wall-mounted microwave oven according to claim 7, wherein the exhaust port is closer to a front side of the microwave oven than a back side of the microwave oven.

12. The wall-mounted microwave oven according to claim 7, wherein the guide plate has a flat plate structure.

13. The wall-mounted microwave oven according to claim 8, wherein an exhaust function of the microwave oven is performable irrespective of the position of the guide plate such that the guide plate does not obstruct the fumes or smoke from entering the exhaust port of the oven body.

14. The wall-mounted microwave oven according to claim 7, wherein:

the guide plate comprises:

an engagement protrusion protruded from one end of the guide plate; and the door comprises:

an engagement groove formed at an upper end of the door to engage with the engagement protrusion of the guide plate to lock the guide plate at a folded position.

15. The wall-mounted microwave oven according to claim 7, wherein the guide plate is attached to and fits into a recess in the door such that in the folded position an exterior surface of the guide plate and an exterior surface of the door form one substantially continuous surface.

16. The wall-mounted microwave oven according to claim 7, wherein the guide plate has a lateral length corresponding to a lateral length of the door, and at least a portion thereof is transparent.

17. The wall-mounted microwave oven according to claim 7, wherein the guide plate hinges to one of a folded position when the guide plate is not in operation and an unfolded position when the guide plate is in operation.

18. The wall-mounted microwave oven according to claim 14, wherein the door further comprises:

a guide plate receiving recess provided at the front surface of the door to receive the guide plate, wherein by folding the guide plate into the guide plate receiving recess and mating the engagement protrusion of the guide plate with the engagement groove formed on the door, the guide plate is locked into a folded position in which the guide plate is not in operation.

19. The wall-mounted microwave oven according to claim 17, wherein:

the guide plate comprises:

one of a guide plate protrusion protruded from one end of the guide plate and a guide plate groove grooved from the one end of the guide plate; and the door comprises:

a corresponding one of a door groove formed at an upper end of the door and a door protrusion protruded at an upper end of the door, respectively, to lock the guide plate into a folded position.

20. The wall-mounted microwave oven according to claim 17, further comprising:

a locking unit to lock the guide plate in the folded position, the locking unit comprising:

an engagement protrusion protruding from one end of the guide plate; and an engagement groove formed at an upper end of the door to engage with the engagement protrusion of the guide plate to lock the guide plate at a folded position.

21. The wall-mounted microwave oven according to claim 17, further comprising:

a stopper provided at a lower front surface of the door to hold the guide plate in the unfolded position when in operation.

22. The wall-mounted microwave oven according to claim 17, wherein the door comprises:

a guide plate receiving recess provided at a front surface of the door to receive the guide plate and hold the guide plate in a folded position.

23. The wall-mounted microwave oven according to claim 17, further comprising:

a stopper provided at a front surface of the door to prevent the guide plate from rotating beyond the unfolded position.

24. The wall-mounted microwave oven according to claim 23, wherein the stopper is integrally formed with the door.

25. The wall-mounted microwave oven according to claim 22, wherein the guide plate receiving recess has a depth corresponding to a thickness of the guide plate.

26. A wall-mounted microwave oven having an oven body, a cooking chamber therein, a door defining an opening of the cooking chamber and an exhaust port formed at the oven body to exhaust fumes or smoke, comprising:

a guide plate hingeably mounted on the door and guiding the fumes or smoke from around the microwave oven toward the exhaust port of the oven body.

27. A wall-mounted microwave oven having an oven body with a cooking chamber therein and an exhaust port formed at the oven body to exhaust fumes or smoke, comprising:

a door having a recess on a front surface thereof; and a guide plate rotatably mounted on the door and received in the recess, guiding the fumes or smoke from around the microwave oven toward the exhaust port of the oven body.

28. A door to a wall-mounted oven for opening and closing an opening of a cooking chamber and guiding exhaust fumes or smoke to an exhaust port, comprising:

a guide plate rotatable mounted on the door at a lower portion thereof to guide the exhaust fumes or smoke to an exhaust port when the guide plate is rotated into a first position, the guide plate being retractable into the door when the guide plate is rotated to a second position.

* * * * *